US012698602B2

(12) United States Patent
Schütz et al.

(10) Patent No.: US 12,698,602 B2
(45) Date of Patent: Aug. 4, 2026

(54) MULTI-LAYER TRAFFIC SUPERSTRUCTURE WITH LIQUID-TIGHT INTERMEDIATE LAYER, METHOD OF MANUFACTURING THE MULTI-LAYER TRAFFIC SUPERSTRUCTURE

(71) Applicant: Wilhelm Schütz GmbH & Co. KG, Weilburg-Gaudernbach (DE)

(72) Inventors: Maximilian Schütz, Darmstadt (DE); Ottmar Wilhelm Schütz, Weilburg (DE)

(73) Assignee: Wilhelm Schütz GmbH & Co. KG, Weilburg-Gaudernbach (DE)

( * ) Notice: Subject to any disclaimer, the term of this patent is extended or adjusted under 35 U.S.C. 154(b) by 647 days.

(21) Appl. No.: 18/132,998

(22) Filed: Apr. 11, 2023

(65) Prior Publication Data

US 2023/0349107 A1 Nov. 2, 2023

(30) Foreign Application Priority Data

Apr. 28, 2022 (DE) ..... 10 2022 110 403.6

(51) Int. Cl.
*E01C 11/26* (2006.01)
*E01C 7/18* (2006.01)
(Continued)

(52) U.S. Cl.
CPC ..... *E01C 11/26* (2013.01); *E01C 7/182* (2013.01); *E01C 7/262* (2013.01); *E01C 19/4826* (2013.01); *E01C 23/00* (2013.01)

(58) Field of Classification Search
CPC ..... E01C 11/26; E01C 7/182; E01C 23/00; C01C 19/4826
See application file for complete search history.

(56) References Cited

U.S. PATENT DOCUMENTS 4,314,772 A * 2/1982 Lestraden ..... E01C 11/26 52/170
7,879,921 B2 * 2/2011 Cummins ..... E01C 11/225 521/64
(Continued)

FOREIGN PATENT DOCUMENTS

CN 101 387 097 A 3/2009
CN 105507115 A 4/2016
(Continued)

OTHER PUBLICATIONS

P. Pascual-Muñoz—Thermal and hydraulic analysis of multilayered asphalt pavements as active solar collectors; Applied Energy, 111 (2013) 324-332. ISSN: 0306-2619.

*Primary Examiner* — Silvana C Runyan
(74) *Attorney, Agent, or Firm* — Schmeiser Olsen PLLC

(57) ABSTRACT

A superstructure for a traffic surface is provided, the superstructure including a base layer of a mastic asphalt, and an intermediate layer of a porous asphalt arranged on the base layer, wherein the base layer seals a lower side of the intermediate layer at least in a liquid-tight manner. The superstructure comprises a top layer of a mastic asphalt arranged on the intermediate layer, wherein the top layer seals an upper side of the intermediate layer at least in a liquid-tight manner. The superstructure includes at least one sealing wall of a mastic asphalt arranged on at least one side surface of the intermediate layer, wherein the at least one sealing wall connects the base layer to the top layer and seals the at least one side surface in at least a liquid-tight manner. A method for manufacturing the superstructure is also provided.

16 Claims, 3 Drawing Sheets

(51) Int. Cl.

| | |
|---|---|
| ***E01C 7/26*** | (2006.01) |
| ***E01C 19/48*** | (2006.01) |
| ***E01C 23/00*** | (2006.01) |

(56) References Cited

U.S. PATENT DOCUMENTS

| | | | | |
|---|---|---|---|---|
| 9,416,274 | B2 * | 8/2016 | Frank | C08L 95/00 |
| 2004/0221769 | A1 | 11/2004 | Hokkirigawa et al. | |
| 2018/0031337 | A1 * | 2/2018 | Guarrero | H01B 1/18 |

FOREIGN PATENT DOCUMENTS

| | | | |
|---|---|---|---|
| DE | 14 09 828 | A | 11/1968 |
| DE | 10 2011008190 | A1 | 7/2012 |
| WO | 01/29321 | A1 | 4/2001 |

* cited by examiner

MULTI-LAYER TRAFFIC SUPERSTRUCTURE WITH LIQUID-TIGHT INTERMEDIATE LAYER, METHOD OF MANUFACTURING THE MULTI-LAYER TRAFFIC SUPERSTRUCTURE

CROSS-REFERENCE TO RELATED APPLICATIONS

This application claims priority to German Application No. 10 2022 110 403.6, having a filing date of Apr. 28, 2022, the entire contents of which are hereby incorporated by reference.

FIELD OF TECHNOLOGY

The following relates to a superstructure for a traffic surface, the superstructure comprising a base layer of a mastic asphalt, and an intermediate layer of a porous asphalt arranged on the base layer, the base layer sealing a lower side of the intermediate layer at least in a liquid-tight manner. The following further relates to a method of manufacturing the superstructure.

BACKGROUND

Asphalt is a temperature-dependent construction material that achieves its optimum material properties within a temperature interval of above 0° C. to about 40° C. If the temperature deviates upwards from this interval, the material becomes increasingly viscous and deformations are formed due to the traffic load, e.g., ruts, which weaken the overall superstructure and reduce the service life.

In addition, asphalt surfaces in urban areas pose problems as a result of heating by solar radiation, storage, and subsequent release of thermal energy to the environment, which causes asphalt surfaces to increase the general temperature level, contributing to the Urban-Heat-Island phenomenon. This results in the following problems:

- reduction in well-being due to persistently high temperatures (especially at night by making restful sleep difficult),
- negative health consequences due to the continuous heat stress on the cardiovascular system,
- increased energy demand due to the increased need for cooling and air conditioning.

On the other hand, problems arise at low temperatures due to cryogenic stresses within the asphalt superstructure as well as damage caused by freeze-thaw cycles of water penetrating the superstructure. Both lead to damage of the superstructure and to a reduction of the service life. This damage to the road structure, for example due to material discharge, leads to a reduction in comfort for road users and a reduction in road safety even in the seasons without icy conditions.

In addition to the material-related problems, frost also causes problems due to the formation of ice and over-freezing or snowing of the asphalt surface. Slippery or over-snowed surfaces make winter maintenance necessary in order to enable the safe use of the surfaces. If road salt is used during winter maintenance, problems also arise due to the negative effects of road salt on groundwater, surrounding flora and fauna. Furthermore, the use of road salt can also cause damage to vehicles and surrounding buildings.

To reduce or avoid these problems, asphalt surfaces can be tempered. This temperature control is achieved by flowing a fluid through the asphalt surface, usually in a pipe coil. However, this results in the following disadvantages:

- the maximum heat transfer area is the product of the length of the pipe with its shell surface, which limits the maximum heat transfer rate,
- the installation of pipes in the superstructure and the deconstruction are complex and expensive due to the high proportion of manual labor, and
- the material costs of the pipe coil result in high overall costs.

To overcome the disadvantages of the pipe register, it is proposed in the papers "Thermal and hydraulic analysis of multilayered asphalt pavements as active solar collectors" (P. Pascual-Muñoz, D. Castro-Fresno, P. Serrano-Bravo, A. Alonso-Estébanez, Applied Energy, Volume 111, 2013, Pages 324-332, ISSN 0306-2619, https://doi.org/10.1016/j.apenergy.2013.05.013) and CN 101387097 A to use a porous intermediate layer instead of the pipe coil to pass the fluid through the asphalt surface. This results in particular in the advantage of a higher heat transfer rate since the contact area between asphalt and fluid corresponds to the inner surface of the pore volume.

A disadvantage of superstructures with a porous intermediate layer, however, is that no cost-effective method is known to date for reliably sealing the intermediate layer so that the fluid does not escape in an uncontrolled manner.

SUMMARY

An aspect relates to a temperature-controllable superstructure for a traffic surface that can be manufactured, operated, and deconstructed at low cost, permits a high heat transfer rate, and functions reliably over the long term without fluid loss.

Embodiments of the invention relate to a superstructure for a traffic surface. The traffic surface may be, for example, a road, a bicycle path, a sidewalk, a parking lot, a taxiway, a runway, or a landing strip.

The superstructure comprises a base layer of a mastic asphalt. The base layer has a thickness of 3 cm to 5 cm, for example. A multilayer design of the base layer consisting of several, for example two, layers, each 3 cm to 4 cm thick, is also possible.

Mastic asphalt is usually considered to be practically vapor-tight. However, it has been shown that in the present application, even the smallest cracks can lead to leaks. Increasing layer thickness reduces the likelihood of pores extending throughout the base layer, or of cracks communicating with each other, allowing fluid to leak through them. A two-layer structure also reduces the likelihood that defects, cracks, or pores in one layer will extend through the entire base layer.

The use of mastic asphalt has the advantage that a good bond can be achieved with the porous intermediate layer and the other components of the superstructure due to the similar material properties. A good bond means less points of attack for fluid leakage.

Mastic asphalt also has low thermal conductivity, which keeps the heat in the layer and does not dissipate it into the ground. The mastic asphalt thus performs a thermal insulation function in addition to the waterproofing function.

The superstructure comprises an intermediate layer of a porous asphalt arranged on the base layer, the base layer sealing a lower side of the intermediate layer at least in a liquid-tight manner, also in a gas-tight manner.

This allows a heat transport fluid, such as water, to flow through the intermediate layer without leaking uncontrollably at the lower side of the intermediate layer. The heat transport fluid can be used to temper the superstructure by either using colder heat transport fluid relative to the superstructure to cool the superstructure or using warmer heat transport fluid relative to the superstructure to heat the superstructure. The heat absorbed by the heat transport fluid when cooling the superstructure can be converted into usable energy, for example, using a heat engine. In addition, heat extracted from the superstructure in summer can be stored to use the heat to heat the superstructure in winter.

The intermediate layer can have different thicknesses depending on the load and the boundary conditions such as temperature, solar radiation, wind speed and properties of the surface. For example, the layer thickness is between 4 cm and 8 cm. An intermediate layer with a thickness of 6 cm has shown good stability and conductivity in a long-term test.

A low layer thickness allows cost-effective production. The layer thickness of 6 cm is particularly suitable for a mix of water-permeable asphalt with a maximum grain diameter of 16 mm, whereby the mix can be composed similarly to type PA 16 T WDA, for example.

The superstructure comprises a top layer of a mastic asphalt arranged on the intermediate layer, the top layer sealing an upper side of the intermediate layer at least in a liquid-tight manner. The top layer thus prevents the heat transport fluid from escaping uncontrolled from the intermediate layer through the upper side. The top layer can be produced from mastic asphalt in a particularly simple and cost-effective manner and can be connected to the other components of the superstructure in a mechanically stable and liquid-tight manner.

The layer thickness of the top layer should be as low as possible so as not to hinder the heat exchange between the upper side of the top layer and the heat transport fluid in the intermediate layer. Depending on the material used, layer thicknesses of 2.5 cm to 3.5 cm are possible, for example. A layer thickness of 3 cm is particularly easy to produce.

The layer thickness represents a compromise between high impermeability, high mechanical resistance, and high stiffness on the one hand and high thermal conductivity on the other.

For heat conduction, the layer thickness should be minimal to allow the highest possible heat transfer rate between the upper side of the top layer and the porous intermediate layer or heat transfer fluid flowing through it.

The lower the layer thickness, the higher the probability that individual defects will lead to leaks in the top layer. Subsequent sealing is possible but has a negative effect on heat transfer. A greater layer thickness also allows greater mechanical resistance and load transfer. In particular, as the thickness increases, the top layer is better able to absorb some of the shear load that would otherwise have to be absorbed by the intermediate layer. Due to its nature, the porous intermediate layer is less capable of absorbing the loads than the top layer.

The superstructure comprises at least one sealing wall of a mastic asphalt arranged on at least one side surface, on two, three, or four side surfaces, of the intermediate layer, the sealing wall connecting the base layer to the top layer and sealing the at least one side surface in an at least liquid-tight, also gas-tight, manner.

The sealing wall thus prevents the heat transfer fluid from escaping from the intermediate layer in an uncontrolled manner at the lateral surface or lateral surfaces. The use of mastic asphalt means that the sealing wall can be produced particularly easily and connected in a particularly stable and tight manner to the base layer and the top layer, which are also made of mastic asphalt.

For example, the sealing wall has a thickness of between 20 cm and 30 cm perpendicular to the side surface. This thickness has been shown in tests to be sufficient for reliable sealing. A smaller thickness of 12 cm is also possible but is more susceptible to material defects that can lead to leaks requiring reworking. A thickness of the lateral sealing wall of more than 12 cm therefore has the advantage that it can be executed with greater reliability without leaks.

A large thickness of the sealing wall results in a large contact area of the sealing wall with the top layer. A large contact area facilitates sealing at the transition between the top layer and the lateral sealing wall, as the probability of individual defects leading to a leakage of heat transfer fluid is significantly reduced.

A large thickness of the sealing wall also has the advantage of being thermally insulating, thus preventing heat from the intermediate layer or from the heat transfer fluid therein from being lost through the sealing wall.

The superstructure additionally comprises at least one connecting part arranged at least partially in the sealing wall for at least liquid-conducting, also gas-conducting, connection of a fluid line for a heat transport fluid to the intermediate layer, an outer side of the connecting part being connected to the sealing wall in at least liquid-tight, also gas-tight, manner.

With the aid of the connecting part, the fluid line can be connected to the intermediate layer particularly easily and without jeopardizing the tightness of the superstructure. The fluid line can comprise, for example, a pipe made of HDPE (High Density Polyethylene), which is characterized by good workability, weathering resistance, resistance to acid and corrosion resistance.

In an embodiment, the superstructure comprises at least two connecting parts so that the heat transport fluid can be simultaneously introduced into the intermediate layer through one connecting part and discharged from the intermediate layer through another connecting part. The introducing connecting part can be arranged higher, at the same height or lower than the discharging connecting part at the intermediate layer.

The outer side of the connecting part can, for example, be connected to the sealing wall in at least a liquid-tight manner by one or more sealing rings and/or a sealing compound, which can, for example, be arranged between the sealing rings. The sealing compound can be designed to prevent leaks due to movements of the sealing wall relative to the connecting part. Along the connecting part, for example, a sealing ring can be arranged in front of the sealing wall and a sealing ring behind the sealing wall.

The connecting part may extend into the intermediate layer or into the distributing tube described below to promote the widest possible distribution in the intermediate layer of heat transfer fluid introduced into the intermediate layer through the connecting part.

The superstructure additionally comprises a distributing tube arranged in the intermediate layer and connected to the connecting part in at least a liquid-conducting manner, also in a gas-conducting manner, for distributing heat transport fluid introduced into the intermediate layer through the connecting part in the intermediate layer.

The distributing tube can also be used as a collecting pipe to collect the heat transfer fluid for discharge from the intermediate layer through the connecting part.

The distributing tube favors large-area distribution of the heat transfer fluid in the intermediate layer or large-area collection of the heat transfer fluid from the intermediate layer with a limited number of connecting parts and thus with a limited number of risk areas for leakage of the sealing wall.

The distributing tube can comprise, for example, a profiled rail that is closed on one side with a perforated plate. The profile rail and/or the perforated plate can, for example, be made of a stainless steel or a plastic.

To prevent damage to the superstructure due to excessive pressure of the heat transport fluid, a fluid line through which the heat transport fluid is supplied to the superstructure has a control fluid column, a pressure valve and/or a pressure reducer, for controlling and/or regulating the pressure of the heat transport fluid in the fluid line. The control fluid column is designed as a riser pipe with an overflow for the heat transport fluid, the overflow returning the overflowing heat transport fluid to a reservoir for the heat transport fluid. The maximum pressure in the fluid line is adjustable via the height of the overflow above the fluid line in a range between 1 mbar and 100 mbar (1 cm to 100 cm water column). However, a pressure of 100 mbar should only be used for short-term flushing of the superstructure. During operation of the superstructure, the pressure should be kept as low as possible without negatively affecting the temperature exchange between the heat transfer fluid and the superstructure or leading to discontinuous flow within the intermediate layer. Depending on the area of the intermediate layer and the flow rate of the heat transport fluid through the intermediate layer, the pressure during operation can be about 10 mbar, for example.

The mastic asphalt of the base layer and/or the sealing wall contains basalt, slag and/or other porous mineral material as aggregate. The basalt, slag or porous mineral material may form part of the aggregate of the mastic asphalt or the entire aggregate of the mastic asphalt. Basalt, slag, and porous mineral materials are characterized by low thermal conductivity so that heat losses from the intermediate layer through the base layer and/or the sealing wall are minimized.

For example, the slag may include blast furnace slag, steel mill slag, copper production slag, and/or foundry cupola slag.

Since industrially produced aggregates based on slags are not as cost-effective as natural aggregates, they should be used when natural aggregates with low thermal conductivity are not available or are insufficient, or when the building development adjacent to the superstructure or the surrounding soil is highly thermally conductive.

The mastic asphalt of the base layer and/or the sealing wall has a maximum grain diameter of 2 mm to 24 mm, of 4 mm to 12 mm, or of 5 mm to 11 mm. The mastic asphalt of the base layer has, for example, a maximum grain diameter of 8 mm or 11 mm. The mastic asphalt of the sealing wall has, for example, a maximum grain diameter of 5 mm.

The probability of cracks or pervious pores increases with increasing diameter of the largest grain of the mastic asphalt mixture, so that the smallest possible largest grain is advantageous. On the other hand, the sealing wall and especially the base layer must be stable enough to take the load of the rest of the superstructure plus the traffic running over it and to be able to transfer it to the layer below, for which the largest possible maximum grain size is advantageous. The mentioned maximum grain diameters have proven to be a suitable compromise between low failure tendency and high stability for practical applications.

The porous asphalt of the intermediate layer has a maximum grain diameter of 4 mm to 32 mm, of 8 mm to 24 mm, or of 16 mm.

As the diameter of the largest grain increases, the minimum layer thickness required increases, and thus the mass of the superstructure and the cost of producing the superstructure also increase.

A large diameter of the largest grain has a positive effect on the pore structure. The number of connected pores, which positively influence the hydraulic conductivity, increases. Better hydraulic conductivity reduces the risk of buildup, which can lead to damage to the overall structure and ultimately to leaks. At the same time, with greater hydraulic conductivity, the amount of water circulated in the layer per unit time can be increased, which can lead to better cooling and heating performance.

Mixes of water-permeable asphalt with a maximum grain diameter of 16 mm, for example a mix similar to type PA 16 T WDA, give the best compromise between conductivity for the heat transport fluid, mechanical resistance, and layer thickness as a porous asphalt for the intermediate layer for practical applications. A design is also possible with water-permeable asphalt similar to type PA 8 D WDA (8 mm maximum grain diameter) or PA 22 T WDA (22 mm maximum grain diameter) if boundary conditions do not permit the use of a mixture similar to type WDA 16. A possible example is the use of the superstructure in an open parking garage. Due to the static design of the building, the superstructure there must not exceed a specified mass.

The porous asphalt of the intermediate layer contains cellulose fibers with a mass fraction of 0.04% to 4%, of 0.1% to 0.5%, or particularly of 0.4%, of the porous asphalt. The cellulose fibers prevent run-off of the binder to allow good bonding of the aggregate of the asphalt by the binder.

The porous asphalt of the intermediate layer contains carbon fibers with a mass fraction of 0.01% to 1%, of 0.05% to 0.2%, or of 0.1%, of the porous asphalt, the carbon fibers having a fiber length of 1 mm to 20 mm, particularly of 3 mm to 10 mm, and/or a tensile strength of 5 GPa to 6 GPa. An average fiber length of the carbon fibers is from 3 mm to 10 mm, or 5 mm.

The carbon fibers are recycled carbon fibers to minimize the cost and resource consumption to produce the superstructure.

In tests, an intermediate layer consisting of a porous asphalt with a maximum grain diameter of 16 mm and a mass fraction of 0.1% carbon fibers and 0.4% cellulose fibers proved to be a viable solution.

Modifying the porous asphalt with carbon fibers results in reduced water sensitivity based on the hydrophobic properties of the carbon fibers. The carbon fibers also improve the cohesion of the porous intermediate layer, making it more resistant to occurring shear loads and pore pressures.

Modifying the porous asphalt with a mass fraction of more than 0.1% carbon fibers leads to a slight improvement in the splitting tensile strength, but also increases the water sensitivity as well as the costs. Therefore, a mass fraction of 0.1% carbon fibers is desired.

One possible mechanism of action of the carbon fibers is that the carbon fibers mix with the cellulose fibers at low addition rates and distribute well. As a result, the carbon fibers have a water-repellent effect and the bitumen detaches from the aggregate to a lesser extent, so that damage is reduced or does not occur. Due to their stiffness, too large an addition of carbon fibers causes the aggregate structure to be pressed apart, so that the stability of the aggregate structure is reduced. However, above a certain amount of addition, the carbon fibers can act like an interlocked reinforcement. The mass fractions of carbon fibers tested ranged from 0% to 5% in increments of 0.1 percentage points and with a total mass fraction of carbon fibers and cellulose fibers together of 0.5%. The best variant across all tests was modified with a mass fraction of 0.1% carbon fibers.

The mastic asphalt of the top layer contains a high thermal conductivity aggregate suitable for road construction, such as quartzite or graywacke, as the aggregate, and the high thermal conductivity aggregate may form part of the aggregate or all of the aggregate of the mastic asphalt of the top layer. An aggregate with high thermal conductivity causes a high heat transfer rate between the surface of the top layer and the intermediate layer or the heat transfer fluid therein.

The mastic asphalt of the top layer has a maximum grain diameter of 2 mm to 32 mm, of 4 mm to 16 mm, ro of 8 mm.

Mastic asphalts with all mentioned maximum grain diameters, in particular 5 mm, 8 mm or 11 mm, can be used for the top layer. However, for smaller maximum grain diameters, more stiffening modifications must be made, or they should only be used on surfaces subjected to lower loads. For larger maximum grain diameters, the problem of possibly insufficient impermeability of the top layer arises. However, top layers with large maximum aggregate diameters can also be used for more heavily loaded traffic areas. A good compromise is a medium maximum aggregate diameter of, for example, 8 mm with a modification of the mastic asphalt, for example with graphite.

The mastic asphalt of the top layer may contain a high proportion of crushed sand relative to the proportion of natural sand, for example, a ratio of crushed sand proportion to natural sand proportion of 1.1:1 or higher, to further improve the mechanical load-bearing capacity.

The mastic asphalt of the top layer may contain waxes, for example fatty acid amides with a mass fraction of 0.1% to 0.9%, or 0.3%, to improve workability in order to keep a mastic asphalt designed with high stiffness (e.g., when modified with graphite and a high crushed sand fraction) installable.

The mastic asphalt of the top layer contains graphite with a mass fraction of 1% to 10%, 1.25% to 5%, or 2.5%, of the mastic asphalt. Graphite improves the thermal conductivity of the top layer so that a high heat transfer rate between the surface of the top layer and the intermediate layer or the heat transport fluid therein becomes possible.

In addition to improving thermal conductivity, the addition of graphite also has the effect of increasing the stiffness and resistance to deformation of the top layer. As a result, fewer loads are passed on to the porous intermediate layer. Since the top layer is better able to absorb loads and is easier to repair if damaged than the intermediate layer, this is advantageous. The addition of graphite also reduces oxidation of the binder when the top layer is installed and thus improves the aging properties of the asphalt binder, especially with regard to aging due to UV radiation.

The thermal conductivity of the top layer cannot be improved indefinitely by adding an arbitrarily high mass fraction of graphite. Graphite has a high specific surface area and thus a high binder requirement. To obtain a stable top layer, the mastic asphalt must also contain more binder as the mass fraction of graphite increases. However, the bitumen used as a binder is a poor thermal conductor and therefore partially cancels out the increase in thermal conductivity due to graphite.

Above a maximum reasonable mass fraction, a further increase in the mass fraction of graphite does not increase the thermal conductivity and has a negative effect on the workability and structure of the mastic asphalt.

The mass fraction of graphite in the mastic asphalt of the top layer should therefore be between 1.25% and 5.0%. A mass fraction of 2.5% has proved particularly advantageous in tests. This significantly improves the thermal conductivity.

A conventional mastic asphalt can also be used for the top layer without modification to increase thermal conductivity. However, this reduces the efficiency of the overall system.

The base layer comprises a sealing layer arranged on an upper side and/or on a lower side of the base layer, the sealing layer sealing the upper side and/or the lower side of the base layer at least in a liquid-tight manner, also in a gas-tight manner, the sealing layer comprising one or more mastic asphalt layers, a bitumen-impregnated nonwoven and/or a single-layer or multilayer bituminous welding sheet. The mastic asphalt layers can, for example, each have a thickness of 3 cm to 4 cm.

The additional sealing layer provides additional protection against loss of heat transfer fluid from the intermediate layer through the base layer. Unmodified mastic asphalt and bituminous welding sheets also have low thermal conductivity, which retains heat in the intermediate layer or heat transport fluid therein and minimizes heat loss to the ground. Thus, in addition to the waterproofing function, the waterproofing layer also performs a thermal insulation function.

The bituminous welding sheet has the further advantage that it can be produced with lateral overhang over the base layer. This lateral overhang can be folded onto the other layers after they have been completed to provide further lateral insulation and sealing.

In an embodiment, the sealing layer is located on the lower side of the base layer so as not to interfere with a connection of the base layer to the intermediate layer and/or to the sealing wall.

The base layer is placed on an asphalt carrying layer, for example with a bitumen mass content of 4% to 5%, of 4.2% to 4.8%, or of 4.5%.

The asphalt carrying layer consists of a conventional asphalt base layer AC 22 T S in accordance with ZTV Asphalt-StB ("Additional Technical Contract Conditions and Guidelines for the Construction of Asphalt Pavements").

In an embodiment, compared to a conventional asphalt carrying layer, the asphalt carrying layer contains a stronger polymer-modified bitumen 25/55-55 A, 10/40-65 A, or even 40/100-65 A to be able to absorb any small stress that may occur without severe deflection. The choice of binder depends on the strength achieved and the expected stress on the entire superstructure and subgrade.

Due to the thicker structure in comparison with a conventional superstructure and the filling with heat transfer fluid, the asphalt carrying layer must transfer a greater load than with a conventional superstructure. The asphalt carrying layer AC 22 T S can be used for all higher load classes according to ZTV Asphalt-StB, so that it can also permanently withstand the loads caused by the superstructure according to embodiments of the invention.

An alternative to this would be the asphalt carrying layer AC 32 T S according to ZTV Asphalt-StB, which, however, has a larger pore volume and more interconnected pores due to the higher maximum grain diameter, which increases the risk of leakage.

The asphalt carrying layer AC 22 T S is desired because it can be applied for all load classes. It also has the smallest pores compared to other asphalt carrying layer designs in this load class, and the increased bitumen content mentioned above further closes these pores.

The asphalt carrying layer is constructed to provide another barrier to the heat transport fluid in addition to the base layer, preventing the heat transport fluid from escaping the superstructure. In addition, the increased bitumen content of the asphalt carrying layer acts as another thermal insulation layer to retain heat in the superstructure.

The asphalt carrying layer contains at least a portion, in particular all, of a low thermally conductive aggregate such as basalt, slag or other porous mineral material.

The following relates to a method of manufacturing the superstructure according to embodiments of the invention.

The process involves spreading the base layer of the superstructure. The base layer is spread, for example, as mastic asphalt layer MA 8 S with road bitumen of grade 20/30 according to ZTV Asphalt-StB with a thickness of 4 cm, either manually or mechanically. Before spreading the base layer, the edge area can be set down using steel rails and aligned to the desired thickness of the base layer. The mastic asphalt of the base layer is spread at a paving temperature of 210° C. to 220° C. by hand or mechanically using a mastic asphalt screed.

Prior to spreading the base layer, the asphalt carrying layer of the superstructure can be placed and compacted, in particular by machine. In this case, the asphalt carrying layer, for example, made of rolled asphalt, is placed by machine with a paver and compacted with a roller suitable for this purpose.

To improve the strength of the subgrade, the subgrade is consolidated prior to application of the asphalt carrying layer, depending on its condition, in particular the moisture content, for example with a lime-cement mixture, in particular in a concentration between 20 kg/m$^2$ and 40 kg/m$^2$. The consolidation counteracts the formation of cracks in the base layer or in the sealing layer as a result of deflection of these layers due to an insufficiently strong subgrade.

The consolidation results in a value of the compressive strength of the subgrade of at least 4 N/mm$^2$.

The consolidation is carried out in such a way that no cracks are formed in the subgrade that could penetrate as reflection cracks into the base layer or into the sealing layer.

An unbound carrying layer is applied to the subgrade consolidated in this way before spreading the asphalt carrying layer. The modulus of elasticity of this unbound carrying layer should not fall below the values specified in the Guidelines for the Standardization of the Superstructure of Traffic Areas (RStO) for load class 32.

In an embodiment, the method includes attaching the sealing wall to the base layer.

Before applying the mastic asphalt sealing wall, a double-walled wooden formwork is produced all around. During application, for example, the MA 5 S mastic asphalt is applied in layers with road bitumen of grade 20/30 in accordance with ZTV Asphalt-StB at an installation temperature of 210° C. to 220° C. and tumbled by hand with a wooden grater to avoid voids between the layers.

A distribution pipe can be attached to the base layer, which can be designed, for example, as a profile rail made of stainless steel with stainless steel perforated sheet, as a profile rail made of plastic (e.g., thermoplastic) with stainless steel perforated sheet or as a profile rail made of plastic with plastic perforated sheet. After the base layer has been applied, but before it cools down, irons are laid out, for example, at the intended position of the distributing tube. Due to the weight of the irons, the base layer is lowered by a few millimeters so that a recess is created into which the distributing tube can be partially inserted. After the base layer has cooled, the irons are removed.

In the recess, the surface of the base layer can be removed by grinding or other processes for a better bond with the distributing tube. The sides of the distributing tube that will be in contact with mastic asphalt are roughened. A primer is applied to the contact surface of the base layer in the recess, as well as to the contact surface of the distributing tube: for the mastic asphalt sealing layer, a mastic asphalt primer, and for the distributing tube, either a plastic or steel primer. In the next step, the distributing tube is bonded to the base layer via the primers by a liquid plastic.

In an embodiment, the method comprises placing the intermediate layer of the superstructure on the base layer so that the at least one side surface of the intermediate layer is sealed by the sealing wall. The intermediate layer is placed, for example, by hand or by machine using an asphalt paver at a temperature of the asphalt of the intermediate layer of from 140° C. to 175° C., or from 160° C. to 170° C., and is rolled statically using a roller with only one pass of the surface.

If the subgrade has a steep slope, the compensation of which is not technically possible or reasonable for cost reasons, conductive materials and/or separating materials are introduced into the intermediate layer to guide the heat transport fluid within the intermediate layer.

To insert the conductive materials and/or separating materials, a joint with a depth of, for example, 6 cm or the depth of the intermediate layer and/or a width of, for example, 10 mm to 15 mm is produced after installation of the intermediate layer, with an angle grinder.

In a first embodiment, after the joint has been produced, the two end faces of the intermediate layer exposed by the separation cut are sealed, for example with liquid plastic (e.g., polymethyl methacrylate) without a carrier insert, in order to prevent spreading into the intermediate layer. In the second step, a fast-reacting mortar, for example the fast-reacting mortar Repro 3K based on polymethyl methacrylate, is filled flush with the surface. After the filled mortar has cured (depending on the addition of a catalyst and the air temperature), the top layer can be placed on top.

In a second embodiment, an asphalt mastic, for example an asphalt mastic 0/2, is placed in the joint after the joint has been made. After the asphalt mastic has cooled, the top layer can be installed. If necessary, it is also advantageous here in advance to seal the end faces of the intermediate layer adjacent to the joint, for example with a hot bitumen coating, in order to prevent the asphalt mastic from spreading into the intermediate layer.

In a third embodiment, after the joint has been made, a layer of a stable, elastic two-component sealant, for example the polysulfide-based two-component sealant Sika Tank PK-25ST, for example with a width of 10 mm, is inserted on the base layer into the joint. In a second step, for example, a Plexiglas sheet with a width of, for example, 8 mm to 10 mm is inserted, which is also bonded in the upper part of the intermediate layer with a layer of a stable, elastic two-component sealant. After the two-component sealant has cured, the top layer is installed.

In a fourth embodiment, after the joint has been made, a foam strip (e.g., sponge rubber) or an impregnated and pre-compressed sealing tape (e.g., a sealing tape used in window installation) is installed in the joint. After the foam strip or sealing tape has expanded, the top layer can be installed.

For all four designs, the deformation across the joint under the anticipated traffic load is checked for suitability in the form of a lane formation test or an equivalent road engineering investigation prior to large-scale installation.

In an embodiment, the method comprises applying the top layer of the superstructure at least to the intermediate layer. The top layer of mastic asphalt is applied, for example, in the same way as the base layer of mastic asphalt is spread.

During transport to the job site, the temperature of the mastic asphalt for the top layer is kept at 200° C. in the digester vehicle to avoid embrittlement of the mastic asphalt. For example, half an hour before paving, the mastic asphalt is heated to the paving temperature of 225° C., for example. The increased temperature is chosen to obtain better workability of the mastic asphalt if it contains graphite.

A scattering material to increase the roughness is applied to the still hot surface of the top layer at an early stage and statically pressed in with a roller. Unbonded scattering material is removed after the top layer has cooled down.

The attachment of the sealing wall is carried out on an upper side of the base layer. The application of the top layer is carried out on an upper side of the sealing wall. By attaching or applying to the upper side of the base layer or the sealing wall, a particularly stable and tight connection of the sealing wall to the base layer or to the top layer is achieved.

In an embodiment, the method additionally comprises applying, and pressing, bituminized chippings, with a diameter of 0.1 mm to 0.6 mm, or of 0.3 mm, onto the upper side of the base layer that has not yet cooled down before attaching the sealing wall to the upper side and/or onto the upper side of the sealing wall that has not yet cooled down before applying the top layer to the upper side. The pressing is done, for example, with a roller.

The chippings create a rough surface with which the sealing wall or the top layer applied on top of it bonds in a particularly stable and tight manner.

The top layer is applied at a temperature of the mastic asphalt of the top layer of 220° C. to 230° C., or 225° C. These temperatures result in a particularly tight bond between the top layer and the sealing wall. The top layer is applied at a higher temperature than the base layer and the sealing wall, so that the mastic asphalt of the top layer can be easily processed despite a modification with graphite.

The application of the top layer involves rolling the top layer with chippings. The chippings ensure sufficient roughness of the surface of the top layer for safe use of the traffic area. In addition, the rolling process forces out of the top layer any capillary pores that could lead to leakage.

The base layer is applied and/or the sealing wall is attached at a temperature of the mastic asphalt of the base layer and/or of the sealing wall of 200° C. to 230° C., or of 210° C. to 220° C. These temperatures result in a particularly tight bond between the base layer and the sealing wall.

In an embodiment, the method additionally comprises creating, drilling, an opening through the sealing wall and introducing a connecting part into the opening, so that the connecting part is set up for at least liquid-conducting, also gas-conducting, connection of a fluid line to the intermediate layer.

Drilling through the sealing wall is accomplished, for example, using a masonry drill bit with an outside diameter of, for example, 0.5 inch to 1.5 inches.

For example, drilling is done with a 4-stage drill bit to obtain a clean wall and not allow an out-of-round drill bit run that could result in uneven drilling, which in turn could make sealing more difficult.

In an embodiment, after drilling through the sealing wall, a cavity is then also drilled into the intermediate layer using a 4-stage drill bit.

If the intermediate layer contains a distribution pipe, an access is drilled through the opening in the sealing wall into the distribution pipe and through the distribution pipe into a cavity in the intermediate layer. Depending on the material of the distributing tube, which may consist of a profiled rail and a perforated plate, different drill bits may be used, for example an iron drill bit to drill through a distributing tube, a profiled rail or a perforated plate made of stainless steel, or a 4-stage drill bit to drill through a distributing tube, a profiled rail or a perforated plate made of plastic and into the porous intermediate layer.

In an embodiment, the method additionally comprises an at least liquid-tight, also gas-tight, connection of an outer side of the connecting part to the sealing wall.

The process additionally comprises at least liquid-conducting, also gas-conducting, connection of the fluid line to the connecting part. The opening through the sealing wall is sucked out and/or the entire intermediate layer is flushed, in particular in both directions, before the fluid line is connected to the connecting part, in order to avoid impurities, settlements or blockages in the system consisting of fluid line connecting part and intermediate layer. Suction and/or flushing can be carried out after the superstructure has been finished, if necessary, for example to remove impurities introduced into the opening and/or the intermediate layer as a result of repairs or conversion work on the superstructure.

BRIEF DESCRIPTION

Some of the embodiments will be described in detail, with references to the following Figures, wherein like designations denote like members, wherein.

DETAILED DESCRIPTION

Figure 1:
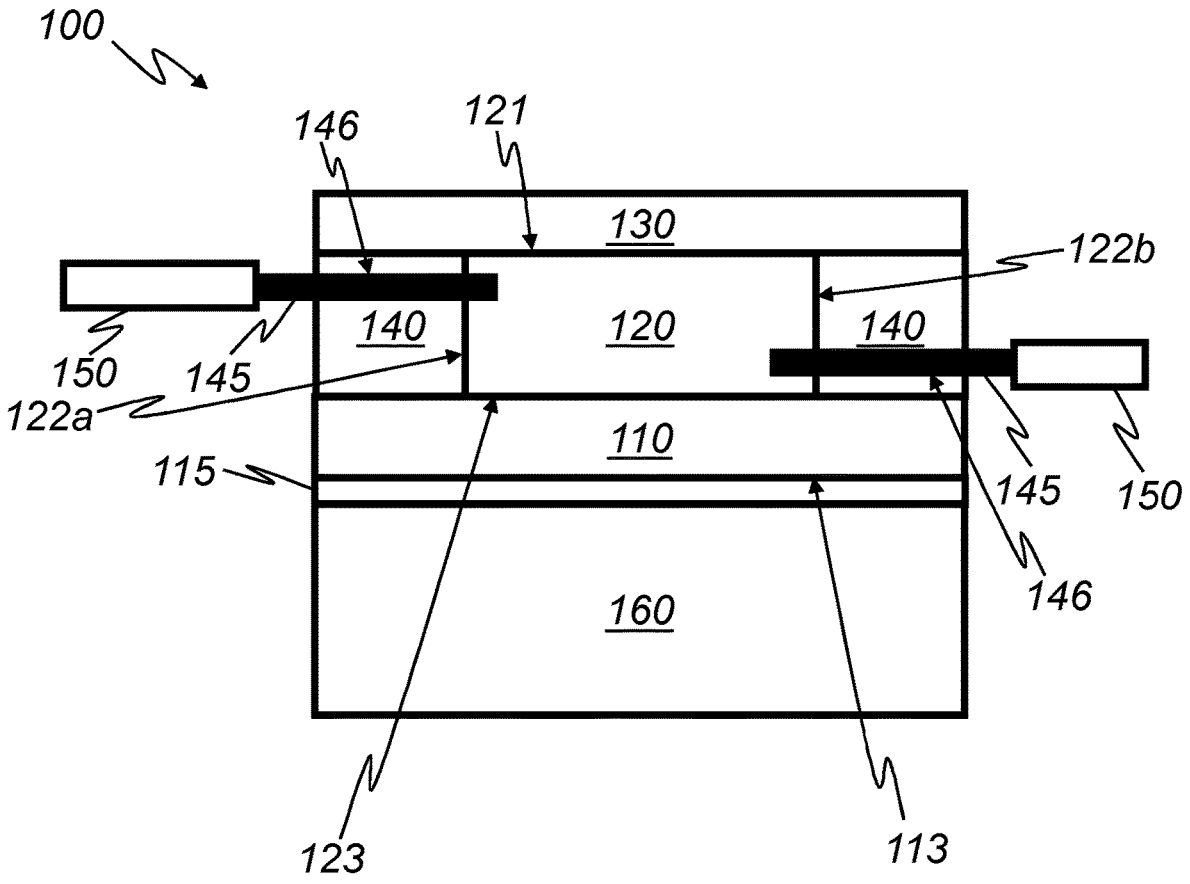
FIG. 1 shows a schematic cross-section of a superstructure according to embodiments of the invention.

FIG. 1 shows a schematic cross-section through a superstructure 100 according to embodiments of the invention.

The superstructure 100 shown includes a base layer 110, for example having a thickness of 3 cm to 5 cm, of a mastic asphalt, for example having a maximum aggregate diameter of 8 mm or 11 mm and having basalt as aggregate.

The superstructure 100 shown comprises an intermediate layer 120 arranged on the base layer 110, for example with a thickness of 6 cm, made of a porous asphalt, wherein the base layer 110 seals a lower side 123 of the intermediate layer 120 at least in a liquid-tight manner. The porous asphalt has, for example, a maximum grain diameter of 16 mm and contains a mass fraction of 0.1% carbon fibers and 0.4% cellulose fibers. The carbon fibers have, for example, a fiber length of 3 mm to 10 mm with an average fiber length of 5 mm and a tensile strength of 5 GPa to 6 GPa.

The superstructure 100 shown comprises a top layer 130 arranged on the intermediate layer 120, for example with a thickness of 3 cm, made of a mastic asphalt, the top layer 130 sealing an upper side 121 of the intermediate layer 120 at least in a liquid-tight manner. The mastic asphalt of the top layer 130 contains, for example, quartzite as aggregate and a mass fraction of 2.5% graphite.

The superstructure 100 shown comprises at least one sealing wall 140 arranged on at least one side surface 122*a*, 122*b*, in the drawing on a left side surface 122*a* and on a right side surface 122*b*, of the intermediate layer 120, for example with a width of 20 cm to 30 cm, made of a mastic asphalt, the sealing wall 140 connecting the base layer 110 to the top layer 130 and sealing the at least one side surface 122 at least in a liquid-tight manner. The mastic asphalt of the sealing wall 140 contains, for example, basalt with a maximum grain diameter of 5 mm as aggregate.

The superstructure 100 shown comprises at least one connecting part 145 arranged at least partially in the at least one sealing wall 140 for at least fluid-conducting connection of a fluid line 150 for a heat transport fluid to the intermediate layer 120, wherein an outer side 146 of the connecting part 145 is connected to the at least one sealing wall 140 in at least a liquid-tight manner.

FIG. 1 shows two connecting parts 145, one of which can serve, for example, as an inlet for the heat transport fluid into the intermediate layer and the other as an outlet for the heat transport fluid from the intermediate layer.

The base layer 110 shown includes a sealing layer 115 disposed on a lower side 113 of the base layer 110, the sealing layer 115 sealing the lower side 113 of the base layer 110 in at least a liquid-tight manner, the sealing layer 115 comprising, for example, a bituminous welding sheet.

The base layer 110 shown is placed on an asphalt carrying layer 160, for example with a bitumen mass content of 4.5%. The asphalt carrying layer 160 can be a conventional asphalt carrying layer AC 22 T S according to ZTV Asphalt-StB. The asphalt carrying layer 160 contains, for example, basalt as aggregate.

FIG. 2

Figure 2:
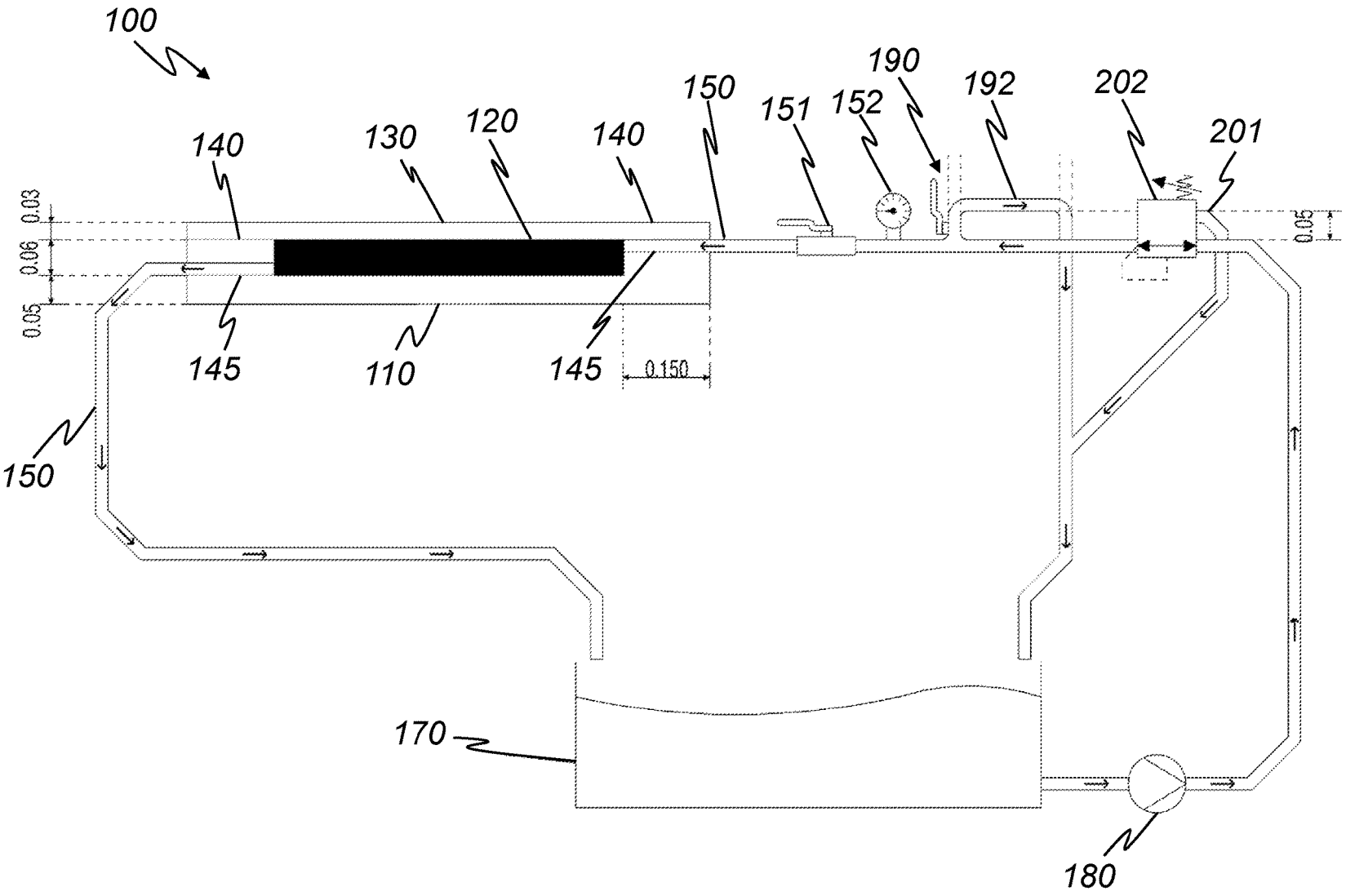
FIG. 2 shows a schematic cross-section through a superstructure according to embodiments of the invention and its supply with the heat transport fluid.

FIG. 2 shows a schematic cross-section through a superstructure 100 according to embodiments of the invention and its supply with the heat transport fluid.

The superstructure 100 shown may be configured, for example, as shown in FIG. 1, although not all features of the superstructure 100 are shown and labeled for clarity.

Some dimensions are exemplarily dimensioned in meters in FIG. 2.

The intermediate layer 120 of the superstructure 100 is supplied with the heat transport fluid (shown by arrows), for example water, through fluid lines 150 connected to the connecting parts 145 of the superstructure. For example, the connecting part 145, through which the heat transport fluid is introduced into the intermediate layer 120 (on the right in FIG. 2), can be arranged as shown in FIG. 2 higher than the connecting part 145, through which the heat transport fluid is removed from the intermediate layer 120 (on the left in FIG. 2).

For example, the heat transfer fluid is pumped by a pump 180 from a reservoir 170 through a fluid line 150 into the intermediate layer 130 and returned through another fluid line 150 from the intermediate layer 130 into the reservoir 170.

The fluid line 150 feeding to the intermediate layer 130 may have a flow meter and/or pressure gauge 152 for measuring the flow of the heat transport fluid into the intermediate layer 130 and/or for measuring the pressure of the heat transport fluid in the fluid line 150 and/or a valve 151, in particular a flow control valve, for regulating the flow.

The fluid line 150 feeding to the intermediate layer 130 may include a control fluid column 190 for controlling the pressure in the fluid line 150 and/or a pressure control valve 202 for adjusting the pressure in the fluid line 150.

The control fluid column 190 includes an overflow 192 through which the heat transfer fluid drains into the reservoir 170 when a maximum pressure is exceeded. To set the maximum pressure, the overflow 192 is adjustable in height above the fluid line 150 (indicated by dashed lines).

In an embodiment, the pressure control valve 202 includes a relief drain 201 through which excess heat transfer fluid is returned to the reservoir 170.

Figure 3:
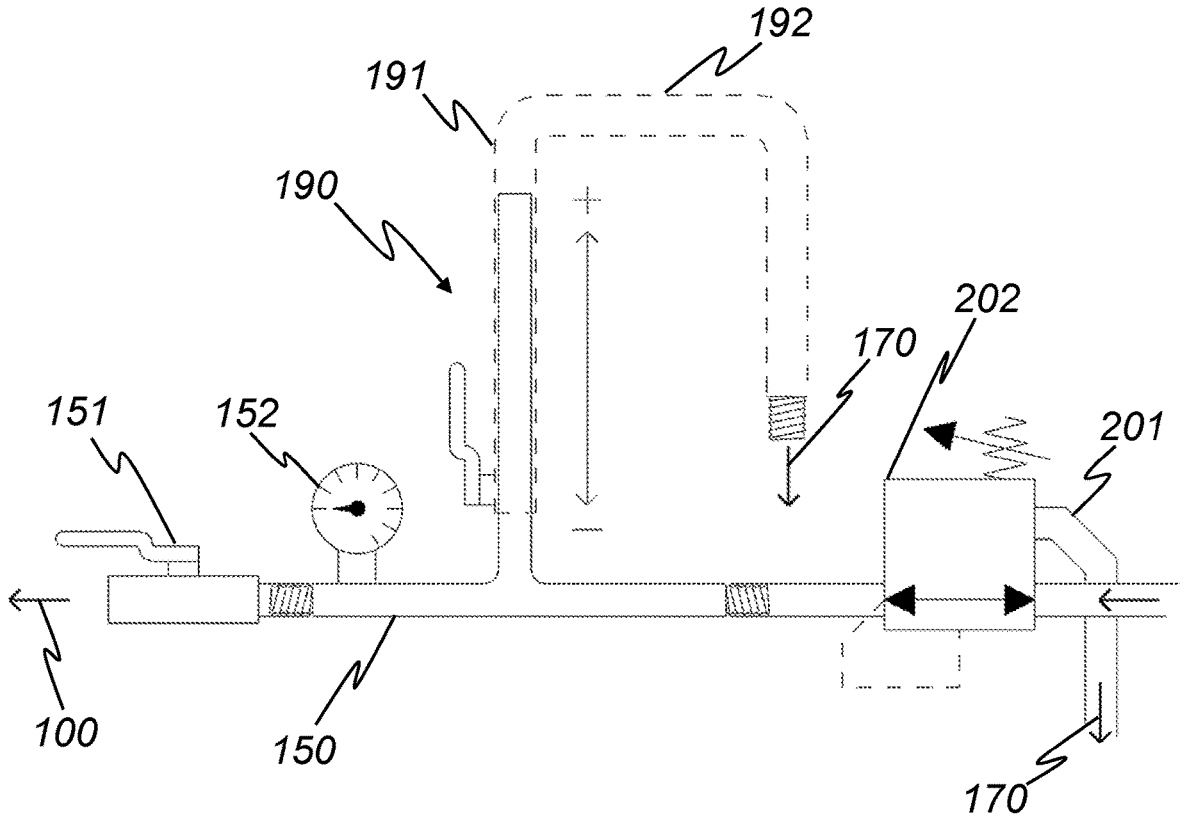
FIG. 3 shows an enlarged section of FIG. 2 in the area of the control fluid column.

FIG. 3 shows an enlarged section of FIG. 2 in the area of the control fluid column 190.

The control fluid column 190 may include an adjustable length riser tube 191 for the heat transfer fluid from the fluid line 150 to adjust the height of the overflow 192 above the fluid line 150.

Figure 4:
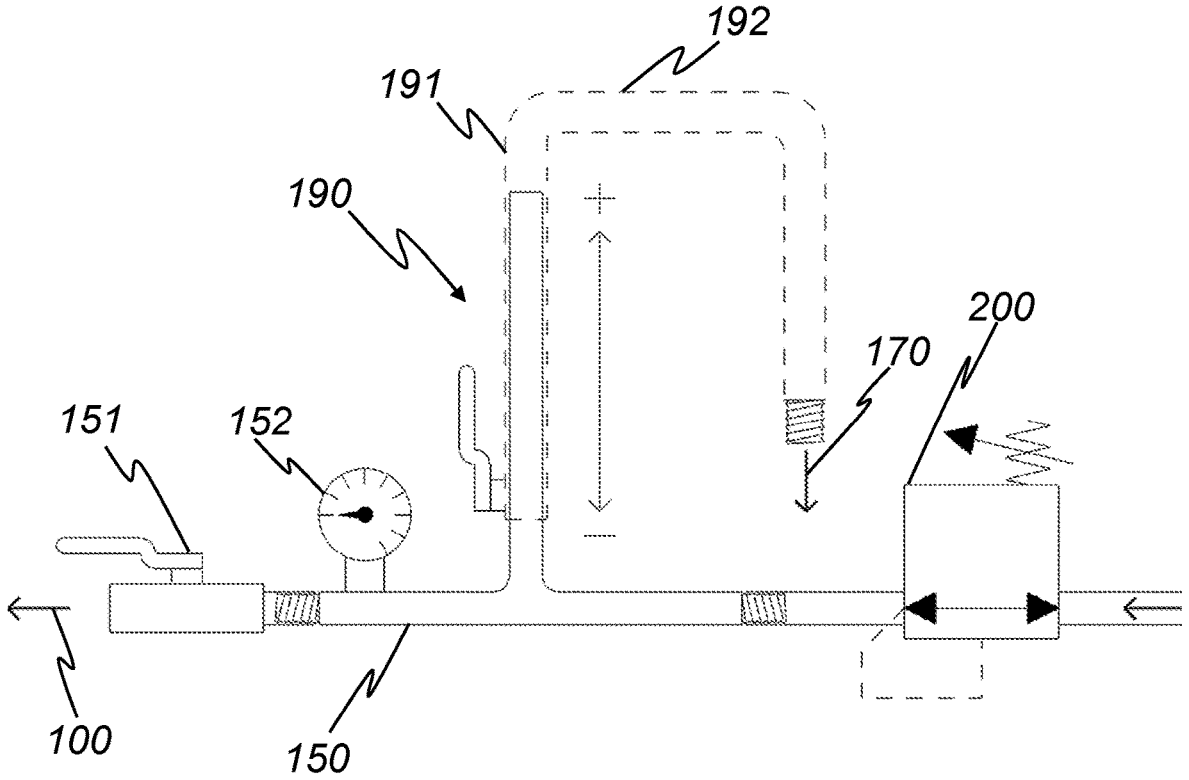
FIG. 4 shows the section of FIG. 3 with an alternative design of supplying the superstructure with the heat transport fluid.

FIG. 4 shows the section of FIG. 3 with an alternative embodiment of supplying the superstructure 100 with the heat transport fluid. In this embodiment, instead of the pressure control valve 202 with relief drain 201, a pressure reducer 200 is provided to adjust the pressure in the fluid line 150.

Although the invention has been illustrated and described in greater detail with reference to the exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

LIST OF REFERENCE SIGNS

| | |
|---|---|
| 100 | Superstructure |
| 110 | Base layer |
| 113 | Lower side of the base layer |
| 115 | Sealing layer |
| 120 | Intermediate layer |
| 121 | Upper side of the intermediate layer |
| 122a, 122b | Side surface of the intermediate layer |
| 123 | Lower side of the intermediate layer |
| 130 | Top layer |
| 140 | Sealing wall |
| 145 | Connecting part |
| 146 | Outer side of the connecting part |
| 150 | Fluid line |
| 151 | Valve |
| 152 | Flow meter and/or pressure gauge |
| 160 | Asphalt carrying layer |
| 170 | Resevoir |
| 180 | Pump |
| 190 | Control fluid column |
| 191 | Riser pipe |
| 192 | Overflow |
| 200 | Pressure reducer |
| 201 | Relief drain |
| 202 | Pressure control valve |

The invention claimed is:

1. A superstructure for a traffic surface, the superstructure comprising:

a. a base layer of a mastic asphalt, b. an intermediate layer of a porous asphalt arranged on the base layer, wherein the base layer seals a lower side of the intermediate layer at least in a liquid-tight manner, c. a top layer of a mastic asphalt arranged on the intermediate layer, the top layer sealing an upper side of the intermediate layer at least in a liquid-tight manner, and d. at least one sealing wall of a mastic asphalt arranged on at least one side surface of the intermediate layer, the at least one sealing wall connecting the base layer to the top layer and sealing the at least one side surface at least in a liquid-tight manner, wherein e. the mastic asphalt of the top layer contains graphite in a proportion by mass of 1% to 2.5% of the mastic asphalt of the top layer.

2. The superstructure according to claim 1, wherein the superstructure additionally comprises at least one connecting part arranged in the at least one sealing wall for at least liquid-conducting connection of a fluid line for a heat transport fluid to the intermediate layer, an outer side of the connecting part being connected in at least liquid-tight manner to the at least one sealing wall.

3. The superstructure according to claim 2, wherein the superstructure additionally comprises a distribution pipe arranged in the intermediate layer and connected to the connecting part in at least a fluid-conducting manner for distributing the heat transport fluid introduced into the intermediate layer through the connecting part in the intermediate layer.

4. The superstructure according to claim 1, wherein the mastic asphalt of at least one of the base layer and/or of the at least one sealing wall a. contains basalt, slag, or combinations thereof, as aggregate, and/or b. has a maximum grain diameter of 2 mm to 24 mm.

5. The superstructure according to claim 1, wherein the porous asphalt of the intermediate layer a. has a maximum grain diameter of 4 mm to 32 mm, and/or b. contains cellulose fibers with a mass fraction of 0.04% to 4% of the porous asphalt.

6. The superstructure according to claim 1, wherein the porous asphalt of the intermediate layer contains carbon fibers with a mass fraction of 0.01% to 1% of the porous asphalt, the carbon fibers having a fiber length of 1 mm to 20 mm and/or having a tensile strength of 5 GPa to 6 GPa.

7. The superstructure according to claim 1, wherein the mastic asphalt of the top layer a. contains quartzite or graywacke as aggregate, b. has a maximum grain diameter of 2 mm to 32 mm, and/or c. contains graphite with a mass fraction of 2.5% of the mastic asphalt of the top layer.

8. The superstructure according to claim 1, wherein the base layer comprises a sealing layer arranged on an upper side of the base layer, on a lower side of the base layer, or on both the upper side and the lower side, the sealing layer sealing the upper side, the lower side, or both the upper side and the lower side at least in a liquid-tight manner, the sealing layer comprising one or more mastic asphalt layers, a bitumen-impregnated fleece, a bitumen welding sheet, or combinations thereof.

9. The superstructure according to claim 1, wherein the base layer is arranged on an asphalt carrying layer with a bitumen mass content of 4% to 5%.

10. The superstructure according to claim 1, wherein the superstructure comprises a fluid line to supply a heat transport fluid to the intermediate layer, wherein the fluid line comprises a control fluid column, a pressure valve or a pressure reducer, for controlling or regulating the pressure of the heat transport fluid in the fluid line.

11. A method of manufacturing the superstructure according to claim 1, the method comprising:

a. spreading the base layer of the superstructure, b. attaching the at least one sealing wall to the base layer, c. placing the intermediate layer of the superstructure on the base layer so that, wherein the at least one side surface of the intermediate layer is sealed by the at least one sealing wall, and d. applying the top layer of the superstructure at least to the intermediate layer.

12. The method according to claim 11, a. wherein the at least one sealing wall is applied to an upper side of the base layer, and/or b. the top layer is applied to an upper side of the at least one sealing wall.

13. The method according to claim 11, wherein the method additionally comprises applying bituminized chippings, namely a. on the upper side of the base layer that has not yet cooled down before the at least one sealing wall is applied to the upper side, b. on the upper side of the at least one sealing wall that has not yet cooled down before the top layer is applied to the upper side, or c. combination of a. and b.

14. The method according to claim 11, wherein the step of applying the top layer a. is carried out at a temperature of the mastic asphalt of the top layer of 220° C. to 230° C., and/or b. includes rolling of the top layer with chippings.

15. The method according to claim 11, wherein spreading the base layer and/or attaching the at least one sealing wall is carried out at a temperature of the mastic asphalt of the base layer, of the at least one sealing wall, or of both the base layer and the at least one sealing wall of 200° C. to 230° C.

16. The method according to claim 11, the method additionally comprising:

a. creating an opening through the at least one sealing wall, b. inserting a connecting part into the opening, wherein the connecting part is arranged for at least fluid-conducting connection of a fluid line to the intermediate layer, c. connecting an outer side of the connecting part to the at least one sealing wall at least in a liquid-tight manner, and d. at least fluid-conducting connection of the fluid line to the connecting part.

* * * * *